US007950645B2

(12) United States Patent
Stauber

(10) Patent No.: US 7,950,645 B2
(45) Date of Patent: May 31, 2011

(54) METHOD AND INSTALLATION FOR THE INSERTION OF SUPPLEMENTS INTO PRINTED PRODUCTS

(75) Inventor: Hans Ulrich Stauber, Grüt (CH)

(73) Assignee: FERAG, AG, Hinwil (CH)

( * ) Notice: Subject to any disclaimer, the term of this patent is extended or adjusted under 35 U.S.C. 154(b) by 98 days.

(21) Appl. No.: 11/554,136

(22) Filed: Oct. 30, 2006

(65) Prior Publication Data

US 2007/0096379 A1 May 3, 2007

(30) Foreign Application Priority Data

Oct. 31, 2005 (CH) ..... 1747/05

(51) Int. Cl.

| | |
|---|---|
| ***B42B 2/00*** | (2006.01) |
| ***B42B 2/02*** | (2006.01) |
| ***B65H 5/30*** | (2006.01) |
| ***B65H 39/00*** | (2006.01) |
| ***B65H 39/02*** | (2006.01) |
| ***B65H 41/00*** | (2006.01) |

(52) U.S. Cl. ..... 270/52.19; 270/52.14; 270/52.16; 270/52.18; 270/52.22; 270/52.21; 270/52.23

(58) Field of Classification Search ..... 270/52.14, 270/52.16, 52.18, 52.19, 52.2, 52.21, 52.22, 270/52.23

See application file for complete search history.

(56) References Cited

U.S. PATENT DOCUMENTS

| | | | | |
|---|---|---|---|---|
| 3,093,396 | A * | 6/1963 | Segreto | 412/16 |
| 3,658,318 | A | 4/1972 | Bunting et al. | |
| 5,137,409 | A * | 8/1992 | Honegger | 412/8 |
| 5,165,672 | A | 11/1992 | Backman | |
| 5,193,851 | A | 3/1993 | Honegger | |
| 5,230,501 | A * | 7/1993 | Melton | 270/41 |
| 5,294,100 | A * | 3/1994 | Scheibelhut | 270/58.09 |
| 5,634,633 | A * | 6/1997 | Graushar | 270/58.05 |
| 5,988,620 | A * | 11/1999 | Graushar | 270/1.02 |
| 6,001,471 | A * | 12/1999 | Bries et al. | 428/317.3 |
| 6,129,346 | A * | 10/2000 | Zorn | 270/52.19 |
| 6,217,271 | B1 * | 4/2001 | Latvakangas et al. | 412/4 |
| 6,739,817 | B2 * | 5/2004 | Rebora et al. | 412/33 |
| 7,073,551 | B2 * | 7/2006 | Silverbrook | 156/356 |
| 2005/0256254 | A1 * | 11/2005 | Luhmann et al. | 524/555 |
| 2006/0034672 | A1 * | 2/2006 | VanDeWalle et al. | 412/33 |

FOREIGN PATENT DOCUMENTS

| | | |
|---|---|---|
| DE | 2118742 | 11/1971 |
| DE | 2160772 | 6/1973 |
| EP | 0540865 | 5/1993 |
| GB | 1150427 | 4/1969 |
| WO | 97/06960 | 2/1997 |

* cited by examiner

*Primary Examiner* — Gene Crawford
*Assistant Examiner* — Yolanda Cumbess
(74) *Attorney, Agent, or Firm* — Rankin, Hill & Clark LLP

(57) ABSTRACT

A method and an installation for the insertion of supplements into printed products (1) such as newspapers, periodicals, brochures, etc., wherein each single, folded or multi-paged printed product (1) is opened over a fold (8) and a supplement (2) is inserted, wherein a leader edge (9) of the supplement (2) is placed at least near the fold (8), or against the spine respectively, of the printed product (1). The method further comprises the following steps of:

Application of a bonding agent (3) to the supplement (2) near the leader edge (9) or to the printed product (1) near the fold (8);

Insertion of the supplement (2) into the printed product (1); and

Adhesion by means of the bonding agent (3), of the supplement (2) in at least one place near its leader edge (9) with the printed product (1).

15 Claims, 2 Drawing Sheets

METHOD AND INSTALLATION FOR THE INSERTION OF SUPPLEMENTS INTO PRINTED PRODUCTS

BACKGROUND OF THE INVENTION

1. Field of the Invention

The invention concerns a method and an installation for the insertion of supplements into printed products, as well as a subsequent combined printed product, according to the generic term of the corresponding independent claims.

2. Description of Related Art

Installations and methods of insertion for the manufacture of printed products are generally known. Accordingly, supplements such as part products or advertising material are inserted into printed products such as newspapers, periodicals, brochures, etc., thus forming a combined printed product. To this end the previously completed and already folded printed product are opened across the fold and a supplement is inserted.

In practice such supplement have presented the disadvantage that they, depending on the handling of the printed products during distribution or by the reader, may slide out.

Another common practice is to affix advertising material such as cards or product samples into a particular position on a predetermined page of a periodical. As the page number is stipulated, this process takes place during the assemblage of the individual sheets of the periodical. A corresponding installation is revealed in the EP 0 540 865 A1. It demonstrates how a rotating row of controllable clamps grips the supplement at a point of supply, guides it past an adhesion application device, and presses it against the exterior surface of the partially assembled printed product. To this end the printed product is supported by a surface element. The clamp presses the supplement against the printed product for as long as it takes the adhesion to become sufficiently stable. This procedure does not permit a supplement to be inserted into a completely assembled printed product.

BRIEF SUMMARY OF THE INVENTION

It is therefore the object of the invention to create a method and an installation for the insertion of supplements into printed products, as well as a subsequent combined printed product which prevents the escape of the supplement. A further object of the invention is to enable a means of supplement allocation to a printed product, which is as flexible as possible, in particular to a previously completed printed product. It is a further object of the invention to achieve this by simple means and on economical terms.

This object is achieved by a method and a installation for the insertion of supplements into printed products, as well as a subsequent combined printed product.

In the method according to the invention for the insertion of supplements into printed products, wherein a leader edge of the supplement is aligned at least approximately against the fold or the spine of the printed product, a bonding agent is therefore applied to the supplement in the proximity of its leader edge, or to the unfolded printed product in the proximity of its fold or of its spine, prior to the insertion. The supplement is inserted into the printed product and by means of the bonding agent the supplement is attached to the printed product in at least one place near the leader edge. The direction of movement of the supplement during insertion, preferably, is perpendicular to the direction of the spine or fold.

Thus, the supplement is affixed to printed product and prevented from dropping out. Being situated in the proximity of the supplement's leader edge and therefore also near the fold or the spine of the printed product, the adhesion sits in an area not unfolded prior to reading. This virtually eliminates the danger of the supplement merely hanging form the adhesion and consequently being torn out. The adhesion therefore protects the supplement from escaping from the folded or possibly lightly thumbed printed product.

A further advantage is the fact that a supplement can be added to a printed product after its completion. This contrasts with the known adhesion methods, which must take place during assemblage presents an excessive restriction, as the order in which the individual sections of a printed product are provided frequently does not allow for it.

Essentially, the bonding agent may be applied to the printed product or the supplement. Applying the bonding agent to the supplement instead of the printed product offers the advantage that a secure adhesion is always guaranteed, regardless of its size compared to the supplement and its end position after the insertion. Thus it is also possible to position the means to apply the bonding agent outside an insertion drum or insertion track. This is easier to construct on one hand and avoids contamination of the machines on the other.

Being controlled by a pulse or phase signal, the bonding agent is applied e.g. to a copystream or imbricated stream or to individually conveyed supplements, advantageously immediately prior to insertion. 'Immediately' meaning e.g. that this takes place less than a meter or a few hundredths of a second respectively before the supplement is inserted. Therefore, when a hot-setting adhesive is used as the bonding agent, the adhesive remains warm and effective after insertion and during compression.

Thus, the supplement is merely inserted or interleaved and not additionally pressed down in the desired position by a special pressure device as is the case e.g. with pasted cards. Experiments have shown that the supplement nevertheless ends up essentially with its leader edge against the fold or spine within the printed product and that a reliable adhesion is achieved. In case the printed product should be opened only marginally, an agglutinable bonding agent may be spread during insertion between the supplement and the printed product across the last few centimeters of the motion, which increases the adhesion area.

A card-pasting device on the other hand, has to position a card on a particular page of the printed product during assemblage, and them hold it down with a corresponding means until the adhesion reached sufficient efficacy. In contrast, according to the invention the supplement can be inserted or interleaved in the usual manner and then left to its own devices. As the printed product is closed again, the adhesion is automatically compressed. In another advantageous embodiment of the invention the bonding area, i.e. the now combined printed product, is compressed by clamps or a clasp along the fold in order to improve the bonding.

Depending on the geometry of the insertion installation and on its position in relation to gravity, the track of the supplement differs at the point of insertion. In those cases in which a particular page of the supplement first comes into contact with the printed product and this page then slides along the printed product, the bonding agent is advantageously applied to the opposite page. If the insertion, rather, takes place in a horizontal direction, this will typically although not necessarily be the front of the supplement. In principle however, the bonding agent can be applied to the front or the back of the supplement. The bonding agent can also be applied to several places along the leader edge of the supplement in order to increase the stability of the adhesion.

Similarly, the bonding agent can be applied to several positions along the fold.

The bonding agent can be removed from the printed product and/or from the supplement—typically by the reader—without damaging it.

The supplement is typically another printed product, but can in principle be any given flat and preferably flexible object, e.g. a product sample. Advantageously, the supplement is of a certain minimal size e.g. a at least half of the surface of the printed product, so that the supplement is affixed more firmly by the friction with the printed product.

The method can be implemented in known insertion drums or insertion tracks.

The installation for the insertion of supplements into printed products such as newspapers, periodicals, brochures, etc. Comprises a feeder for the supply of supplements, an insertion installation for the opening of the printed products and for the insertion of the supplements with a leader edge towards a fold or a spine of the relevant printed products, wherein the installation comprises a means to apply a bonding agent to the supplement in the proximity of the leader edge or to the unfolded product in the proximity of the fold or of the spine prior to the insertion.

The combined printed product, thus, comprises a printed product with an inserted supplement, wherein the printed product and the supplement are attached by at least one adhesive point or bonding area, and wherein die adhesive point or adhesive points concerning the supplement are situated in the proximity of an edge of the supplement, which edge is essentially aligned along a fold or a spine of the printed product.

The properties of the method claims can be combined in analogy with the installation claims, and vice versa.

BRIEF DESCRIPTION OF THE FIGURES

In the following the object of the invention is explained in more detail on the basis of a preferred example of embodiment, which is illustrated in the enclosed figures. Demonstrating in schematic diagrams are.

The reference symbols used in the figures and their meaning are summarily listed in the List of Reference Symbols. Fundamentally identical parts in the figures are indicated with identical reference symbols.

DETAILED DESCRIPTION OF THE INVENTION

In the following, the invention is illustrated on the basis of a folded printed product, e.g. a newspaper which is unfolded for the purpose of reading or a periodical which is folded and fastened in the fold by staples. Of course, the same is also applicable for bound or glued multi-paged printed products, into which a supplement is to be inserted. Such printed products comprise a spine and the supplement is inserted towards the spine on the inside of the product.

Figure 1A:
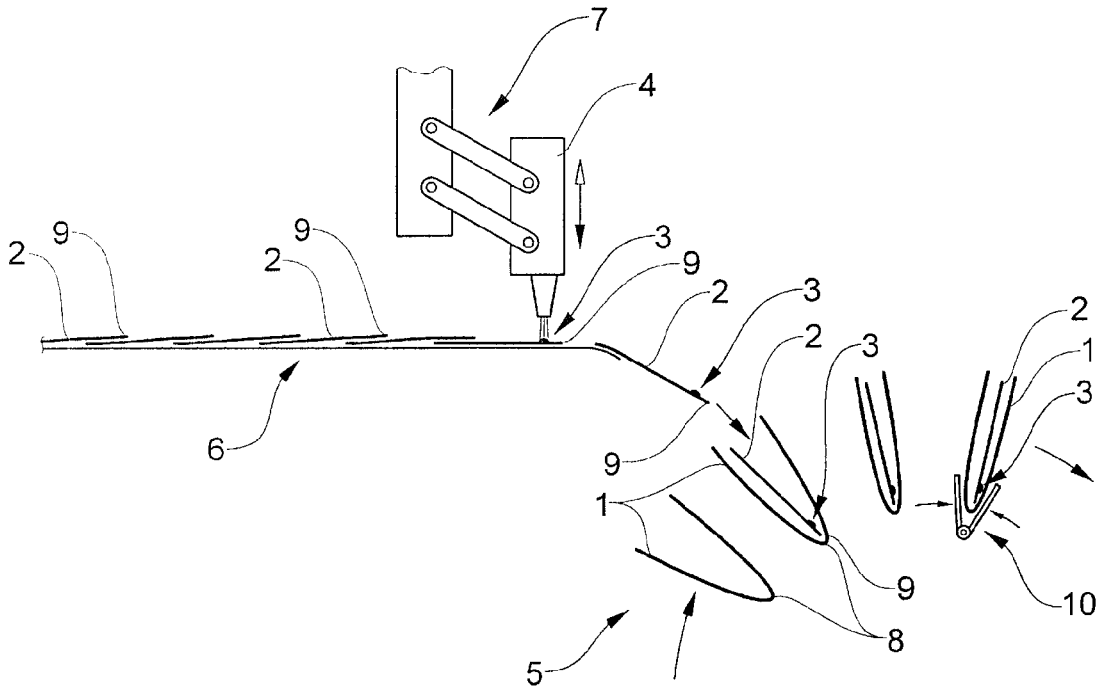
FIG. 1A an installation for the insertion according to the invention.
Figure 1B:
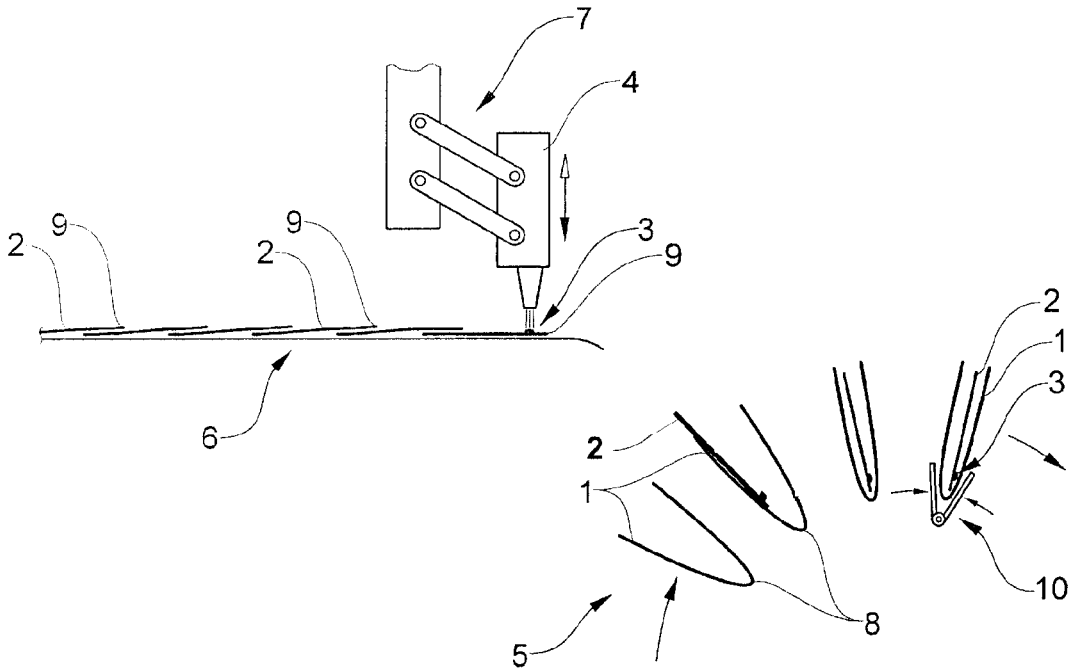
FIG. 1B an installation for the insertion also according to the invention.

FIG. 1 shows an installation for the insertion according to the invention. Printed products 1 are conveyed in an insertion drum 5 in the direction indicated by the arrow, opened and brought into a position for the insertion of supplements 2. Naturally the printed product 1 is opened at least to the extent required for the insertion. The exact location at which the printed product 1 is opened is usually not important. Thus consecutive copies of the printed product 1 may be opened between sets of pages. The supplements 2 are delivered by a supplement loader 6 and in the stated position inserted or interleaved into the opened printed products 1. In this process a leader edge 9 of the relevant supplement 2 arrives at the fold 8 of the relevant printed product 1 or at least near the fold 8. In the area of the supplement loader 6, an injector 4 is positioned for the application of an adhesive 3, advantageously of a hot-setting adhesive, as a bonding agent onto the supplements 2. By means of a rotating mechanism 7 the injector 4 can be brought forth or retracted as well as adjusted to the height of the supplements 2 in the supplement loader 6. If necessary, the injector 4 can also be moved alongside the supplement 2 while the adhesive 3 is being administered.

The supplements 2 are advantageously conveyed in a pulsed or phased manner, e.g. in an imbricated stream or copystream, in a stacked copystream, singly, etc., in any case in such a manner that the leader edge 9 of the supplement 2 is exposed in the operative range of the injector 4. The adhesive 3 is applied to the supplement 2 by the injector 4 at one or several points near or along the leader edge 9. If one or several of the supplement 2 are missing, e.g. in a pulsed supplement loader, the application of the adhesive is suppressed accordingly.

Advantageously, the adhesive is administered a few hundredths of a second prior to the insertion of the supplements. A typical production speed is e.g. 40,000 copies per hour. There may be several different supplement loaders 6, each equipped with its own injector 4. In this manner various supplements 2 can be inserted and affixed in the same printed product 1.

Subsequently the supplement 2 is inserted or interleaved in a generally known manner by the supplement loader 6 into the printed product 1 delivered and opened by means of the insertion drum 5. The printed product 1 is carried on by the insertion drum 5 and simultaneously closed, the adhesive 3 being pressed against the inside of the printed product 1 in the proximity of the fold 8. Thus, the supplement 2 and the printed product 1 are spot-fastened and the supplement 2 is protected from sliding out.

Advantageously, the printed product 1 is compressed by clamps 10 at least in the vicinity of the fold 8 as it is closed. This improves the quality of the adhesion.

In the example here presented, the course of motions in an insertion drum 5 is shown in schematic diagram. Of course other insertion installations in accordance with the invention may be employed instead, which insertion installations open a printed product 1 and insert another printed product or a flat object as a supplement 2.

Figure 2A:
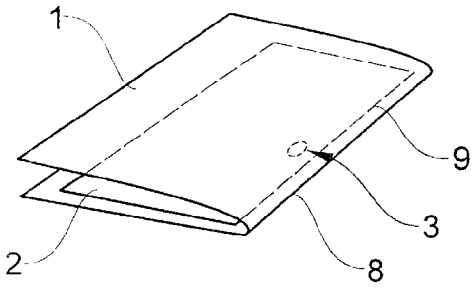
FIG. 2A a combined printed product, utilizing adhesive, according to the invention.
Figure 2B:
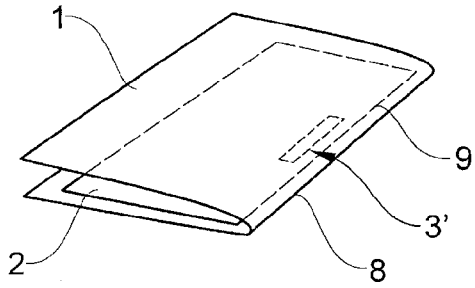
FIG. 2B a combined printed product, utilizing adhesive tape, according to the invention.

FIG. 2 shows a printed product 1 according to the invention. The printed product 1 is folded over a fold 8 and the supplement 2 lies in essentially any location, i.e. between essentially any set of pages. Near the edge 9 of the supplement 2, which is situated nearest to and alongside the fold 8, is a bonding area with adhesive 3, which bonding area affixes the supplement 2 to the printed product 1. Thus, the bonding area is situated between a few mm and a few cm, e.g. up to 2 cm or up to 5 cm from the edge 9. During normal handling of the printed product 1 therefore the supplement 2 is fastened and does not slide out.

LIST OF REFERENCE SYMBOLS

1 Printed product
2 Supplement
3 Adhesive
4 Injector
5 Insertion drum
6 Supplement loader
7 Rotating mechanism
8 Fold
9 Leader edge
10 Clamps

The invention claimed is:

1. A method for the insertion of supplements into completed, folded or multi-paged printed products, wherein the completed printed products are newspapers, periodicals or brochures, wherein the method comprises the following steps:

Conveying of supplements in a pulsed or phased manner towards an insertion installation;

Applying a bonding agent on to the supplement in the proximity of a leader edge or onto the opened printed product in the proximity of the fold immediately prior to insertion;

Opening the completed printed product;

Inserting the supplement into the completed printed product with a direction of movement of the supplement during insertion being perpendicular to the direction of the fold or the spine of the completed printed product, whereby the insertion takes place by interleaving the supplement, in a high speed unguided manner, into the completed printed product;

Situating the leader edge of the supplement at least in the proximity of the fold or of the spine of the completed printed product;

Attaching the supplement to the completed printed product by closing the printed product and thereby pressing the bonding agent against the inside of the printed product in the proximity of the fold or spine; and Adhering, by means of the bonding agent, of the supplement in at least one place in the proximity of the leader edge to the printed product, wherein the bonding agent is removable from the printed product and/or from the supplement without damaging the printed product or the supplement.

2. The method according to claim 1, wherein the bonding agent is applied to the supplement.

3. The method according to claim 1, wherein the bonding agent is applied to the printed product.

4. The method according to claim 1, wherein the bonding agent is applied to several areas of the supplement or the printed product respectively.

5. The method according to claim 4, wherein the bonding agent is applied immediately prior to the insertion of the supplement.

6. The method according to claim 1, further comprising the step of, following the insertion of the supplement, closing and compressing the printed product, using clamps, at least in the region of the bonding agent.

7. The method according to claim 1, wherein the bonding agent is a hot-setting adhesive which is transparent after cooling.

8. The method according to claim 1, wherein the bonding agent is a double-sided adhesive tape.

9. The method according to claim 1, wherein the surface of the supplement measures at least half the surface of the folded printed product.

10. The method according to claim 1, wherein the direction of movement of the supplement during insertion is perpendicular to the direction of the spine or fold.

11. The method according to claim 1, wherein, during insertion, the supplement slides along the printed product.

12. The method according to claim 1, wherein consecutive copies of the printed product are opened between different sets of pages.

13. A set of consecutive copies of combined printed products, wherein the combined printed products are newspapers, periodicals, brochures, etc., produced by the method according to claim 1, each combined printed product comprising a printed product with an inserted supplement, wherein the printed product and the supplement are attached by at least one bonding area, wherein the bonding area or bonding areas concerning the supplement are positioned in proximity of an edge of the supplement, which edge is essentially aligned with a fold or a spine of the printed product wherein the bonding agent is removable from the printed product and/or from the supplement without damaging the printed product or the supplement and wherein, in consecutive copies of the printed product, the supplement is located between different pages of the printed product.

14. A method for the insertion of removable supplements into multi-paged completed printed products, the multi-paged completed printed products being newspapers or periodicals or brochures, wherein a leader edge of the supplement is situated at least in the proximity of the fold or of a spine of the completed printed product, wherein the method comprises the following steps:

applying a bonding agent onto the supplement into the opened completed printed product, wherein during insertion, which takes place by interleaving the supplement into the printed product in a high speed and unguided manner, the supplement slides along the completed printed product, with the direction of movement of the supplement during insertion being perpendicular to the direction of the fold or the spine of the completed printed product and adhering, by means of the bonding agent, of the supplement in at least one place in the proximity of the leader edge to the completed printed product, wherein the bonding agent is removable from the completed printed product and/or from the supplement without damaging the completed printed product or the supplement.

15. The method of claim 14, wherein the step of transporting and opening the multi-paged printed product are performed by an insertion drum.

* * * * *